US005902046A

United States Patent [19]

Shibata

[11] Patent Number: 5,902,046

[45] Date of Patent: May 11, 1999

[54] PACKAGING BAG

[75] Inventor: Yukihiko Shibata, Nagoya, Japan

[73] Assignee: Daiwa Gravure Co., Ltd., Aichi-ken, Japan

[21] Appl. No.: 08/895,422

[22] Filed: Jul. 16, 1997

[51] Int. Cl.[6] ..... B65D 30/10; B65D 33/01

[52] U.S. Cl. ..... 383/107; 383/102; 383/103

[58] Field of Search ..... 383/100, 101, 383/102, 103, 107

[56] References Cited

U.S. PATENT DOCUMENTS

| | | | |
|---|---|---|---|
| 3,198,419 | 8/1965 | Canno | 383/102 |
| 4,311,477 | 1/1982 | Kitamura et al. | 383/102 X |
| 5,376,392 | 12/1994 | Ikegami et al. | 383/103 X |

FOREIGN PATENT DOCUMENTS

| | | | |
|---|---|---|---|
| 647962 | 2/1993 | Australia | 383/102 |
| 0311423 | 12/1989 | European Pat. Off. . | |
| 3014460 | 1/1991 | Japan | 383/102 |
| 2025894 | 1/1980 | United Kingdom | 383/102 |

OTHER PUBLICATIONS

Patent Abstracts Of Japan, vol. 097, No. 005, May 30, 1997 & JP 09 002490 A (Daiwa Gravure Co Ltd), Jan. 7, 1997, *abstract*.

*Primary Examiner*—Jes F. Pascua
*Attorney, Agent, or Firm*—Fildes & Outland, P.C.

[57] ABSTRACT

The invention is a packaging bag for storing contents such as coffee beans and MISO (fermented soybean paste) that breathe and produce gas, which is capable of controlling oxidization of the contents during storage as well as venting the gas produced inside the bag. The body of the packaging bag includes a vent line formed on a part thereof and a synthetic resin film layer provided along the vent line; wherein the film layer contains particles made of a material that does not melt at the melting point of the film layer, and is drawn to be stretched. In the bag thus constructed, fine interstices are formed as ventholes adjacent to each particles in the thickness direction of the film layer so as to allow the gas inside the bag to be vented therethrough, when the bag expands with the gas produced by the contents through their breathing and the pressure inside the bag reaches a certain level.

4 Claims, 8 Drawing Sheets

PACKAGING BAG

FIELD OF THE INVENTION

This invention relates to a packaging bag for storing coffee beans (including ground coffee beans) or fermented foods such as MISO (fermented soybean paste) which is capable of venting gas produced by its contents through their breathing.

BACKGROUND OF THE INVENTION

As a bag for packaging coffee beans or MISO (fermented soybean paste), those provided with venthole portions so as to degas them have been well known.

When the contents are coffee beans, it is enough to provide the bag with venthole portions of which size is smaller than that of coffee beans. However, when the content is MISO, the location of venthole portions should be carefully determined so that MISO may not be spilled through such venthole portions. And it has been a problem that for a bag for packaging MISO, it should be provided with venthole portions exclusively at its top, in addition, it should be stored and displayed with their venthole portions facing upwards. Further, though coffee beans and MISO should be stored being prevented from oxygen as much as possible, if the size of the venthole portions are too large, oxygen outside the bag easily flows in the bag and oxidizes the contents.

DISCLOSURE OF THE INVENTION

In view of these difficulties, it is an object of the present invention to provide a packaging bag which allows to prevent its contents such as coffee beans or MISO from being oxidized during storage, to prevent its contents, for example MISO, from being spilled whether it is let to lie or stand, and to vent gas produced by its contents.

The points of the present invention to accomplish the above object are as follows:

(1) A packaging bag for storing such contents as produce gas through breathing, comprising a vent line formed in a part of its body and a synthetic resin film layer provided in such a location that the vent line is formed; wherein the above film layer contains particles made of a material which does not melt at the melting point of the film layer, and is drawn to be stretched.

(2) The packaging bag as described above, wherein the body of the bag is composed of a synthetic resin material.

(3) The packaging bag as described above, wherein the diameter of the particles is nearly the same as the thickness of the film layer.

(4) The packaging bag as described above, wherein the diameter of the particles is smaller than the thickness of the film layer and a large number of said particles are provided in the film layer in the thickness direction thereof.

(5) The packaging bag as described above, wherein the material of the particles is synthetic resin having a melting point higher than that of the material composing the film layer.

(6) The packaging bag as described above, wherein the material of the particles is non-synthetic resin.

(7) The packaging bag as described above, wherein the film layer is provided with a nonwoven fabric layer in such a manner that the nonwoven fabric layer is bonded to the outside of said film layer by partial adhesion.

(8) The packaging bag as described above, wherein the vent line is formed in such a manner that the two ends of the material composing the body of the bag are not butted together but a slit-like space is left between them in such a location that the vent line is to be formed.

(9) The packaging bag as described above, wherein the body of the bag is provided with cover pieces at each end of the material in such a manner that they overlap each other outside the vent line along the vent line, one of said cover pieces overlapping the outside of the vent line and the other overlapping the outside of the former.

(10) The packaging bag as described above, wherein the body of the bag is provided with cover pieces at each end of the material in such a manner that they overlap each other outside the vent line in a mitered manner.

(11) The packaging bag as described above, wherein the body of the bag is provided with a cover portion outside the film layer, said cover portion being integrated with the body of the bag and having at least one notch formed thereon.

According to the construction of the packaging bag described above, the bag comprises a vent line formed on a part of its body and a synthetic resin film layer provided in such a location that the vent line is formed; wherein the film layer contains particles made of such a material that does not melt at the melting point of said film layer, and is drawn to be stretched. Such a construction allows to form fine interstices serving as vent holes adjacent to each particle in the direction of the thickness of the film layer, because the film layer contains particles made of such a material that does not melt at the melting point of the film layer. Thus, when the packaging bag expands with gas produced by the contents through their breathing and the pressure inside the bag reaches a certain level, the gas is led to go out through the fine interstices. Repeating this procedure allows the bag to be kept expanded to such an extent that it will not burst. In addition, the size of the fine interstices formed in the film layer is small enough not to let the contents of the bag spill, so that the contents can be kept from spilling while the gas is vented from the bag, no matter whether the bag is let to stand or lie. Furthermore, when the packaging bag expands with the gas produced by the contents through breathing, the fine interstices formed on the film layer can let the gas pass through them from the inside of the bag. On the other hand, they can also inhibit the air (oxygen) outside the bag from flowing in. Furthermore, the air (oxygen) is inhibited from flowing into the vent line without failure by way of providing cover pieces at each end of the material of the body of the bag in such a manner that they overlap each other outside the vent line along the vent line, or by way of providing a cover portion outside the film layer, said cover portion being integrated with the body of the bag and having at least one notch formed thereon. Thus, the quality of the contents of the bag can be prevented from deteriorating.

DESCRIPTION OF THE EMBODIMENTS

Figure 1:
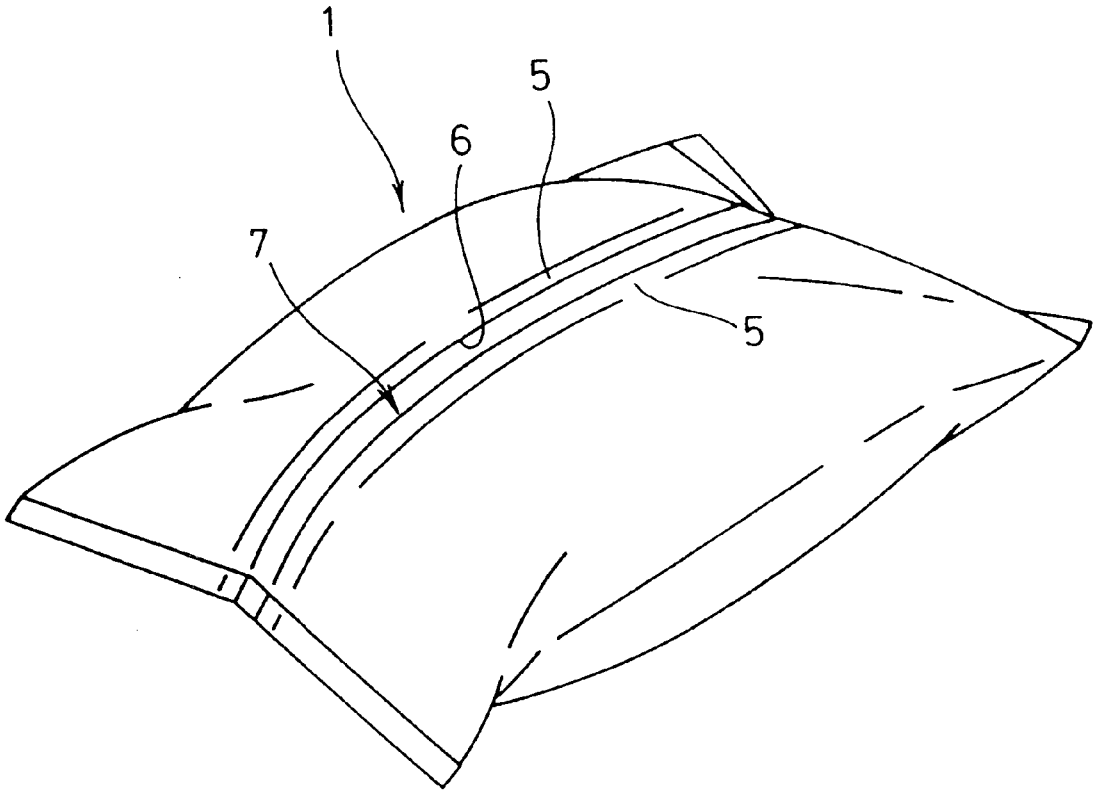
FIG. 1 is a perspective view of a packaging bag according to Embodiment 1 of the present invention.
Figure 2:
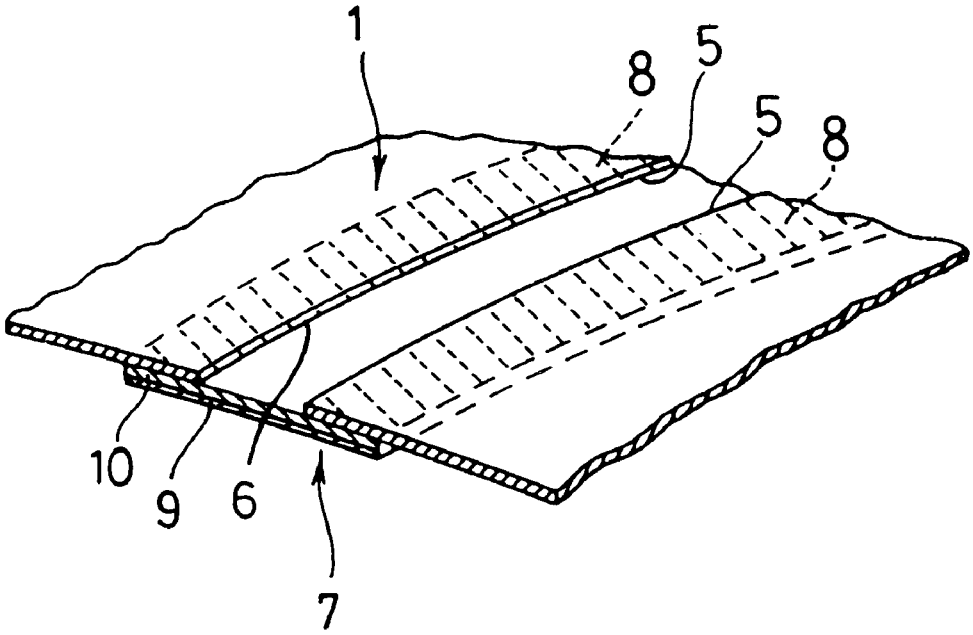
FIG. 2 is an enlarged perspective view of the main part of the packaging bag.
Figure 3:
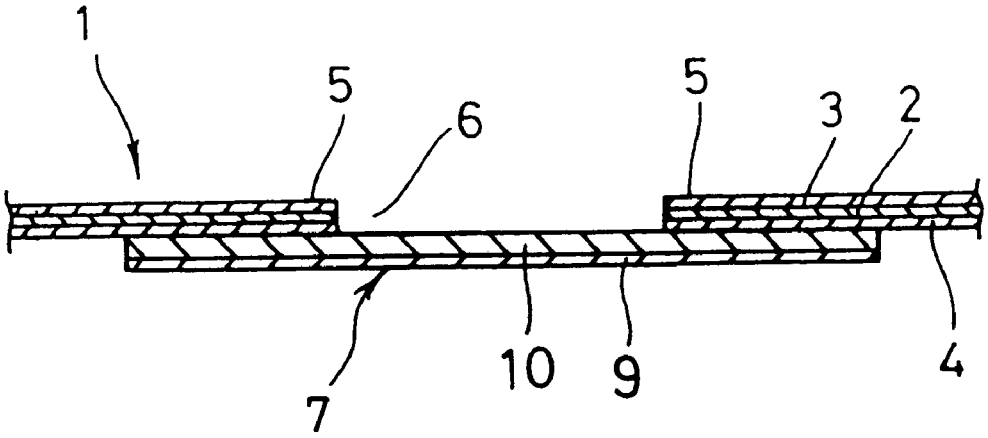
FIG. 3 is an enlarged sectional view of the main part of the packaging bag.
Figure 4:
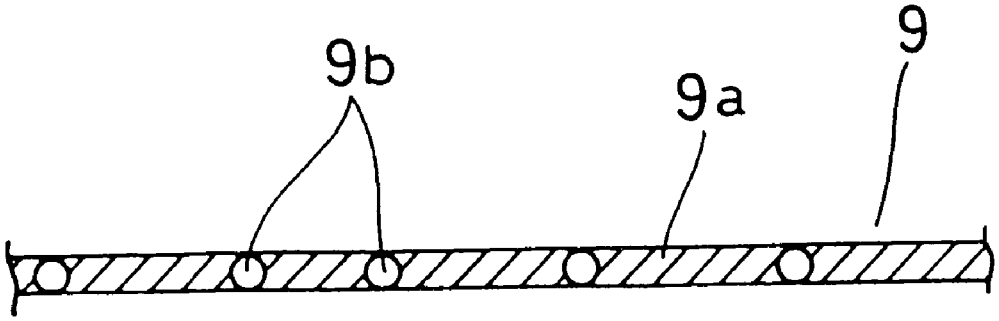
FIG. 4 is an enlarged sectional view of a film layer of a breathable sheet.

FIG. 1 to FIG. 4 illustrate Embodiment 1 of the present invention.

In FIG. 1 to FIG. 4, reference numeral 1 indicates the body of a packaging bag made of a synthetic resin material which is a laminated material consisting of a coating layer 2 of vinylidene chloride provided to obtain a barrier property to prevent oxidization, a film layer 3 comprising poly (ethylene terephthalate), nylon, polypropylene and so on, and a film layer 4 of polyethylene, all of the layers being bonded together. The coating layer 2 is provided on the inside of the film layer 3, and the polyethylene film layer 4 is provided on the inside of the coating layer 2. The body 1 of the packaging bag is formed in such a manner that a sheet of the above material is bent to have a cylindrical shape and the ends of the material, 5 and 5, are not perfectly butted but leave a slit-like space between them to form a vent line 6, and a tape-like breathable sheet 7 is placed on the inside of the sheet of the material to connect said ends 5 and 5. The overlapping portions of the widthwise ends of the sheet 7 with the ends 5 and 5 are bonded by heat adhesion. Reference numeral 8 indicates the bonded portion. In particular, the sheet 7 is composed of a film layer 9 and a nonwoven fabric layer 10 lying on top of the outside of the film layer 9. The film layer 9 consists of a polyethylene film 9*a* having a thickness of about 30 $\mu$m to 50 $\mu$m and particles 9*b* having almost the same diameter as the thickness of the polyethylene film 9*a* which are randomly contained in the polyethylene film 9*a*. The polyethylene film 9*a* is weakly stretched in the uniaxial direction, so that the connection between the particles 9*b* and the polyethylene film 9*a* is cut in their boundary portions and fine interstices (about 2 $\mu$m) are formed in said portions. The particles 9*b* may be of a synthetic resin such as polyethylene or polypropylene which has a melting point higher than that of the polyethylene film 9*a*, or of a non-synthetic resin such as calcium carbonate. The nonwoven fabric layer 10 consists of a long-fiber nonwoven fabric, i.e. for example, a spun-bonded nonwoven fabric made of a long fiber having a core-sheath structure, where the core component is poly(ethylene terephthalate) and the sheath component is polyethylene. The film layer 9 and the nonwoven fabric layer 10 are bonded together by partial heat adhesion. As to this heat adhesion, in particular, polyethylene, the sheath component of the nonwoven fabric layer 10, and the film layer 9 are fused by heating to bond to each other. Partial heat adhesion is performed by, for example, providing spot heat adhesion portions at suitable intervals or providing a lattice heat adhesion portion. The sheet 7 thus constructed is placed on the inside of the body 1 of the packaging bag with the nonwoven fabric layer 10 facing outside and overlapping with the polyethylene film layer 4 inside the body 1 of the packaging bag. The entire overlap portion is bonded by heat adhesion. The heat adhesion between the nonwoven fabric layer 10 of the sheet 7 and the polyethylene film layer 4 inside the body 1 of the packaging bag is performed in the same manner as in the heat adhesion between the film layer 9 and the nonwoven fabric layer 10 of the sheet 7; specifically, polyethylene, the sheath component of the nonwoven fabric layer 10, and the film layer 4 are fused by heating to bond to each other. In heat adhesion of the nonwoven fabric layer 10 of the sheet 7 to the polyethylene film layer 4 inside the body 1 of the packaging bag, an invention is made such that the portion of the sheet 7 which is located along the vent line 6 between the ends 5 and 5 of the body 1 of the packaging bag may not be melted. The reason for this is to make the portion of the sheet 7 along the vent line 6 breathable. The vent line 6 is formed in the longitudinal direction of the cylindrical body 1 of the packaging bag. And, to be contained in the cylindrical body 1 of the packaging bag are coffee beans, MISO or the like which produce gas through breathing, and the longitudinal end portions of the cylindrical body 1 of the packaging bag are closed by heat adhesion.

In packaging bags having the above construction, such contents as coffee beans that produce gas through breathing are contained to be stored and displayed. In this condition, as coffee beans produce gas through breathing, pressure within the packaging bag gradually increases and the bag expands. When the pressure inside the bag reaches a certain level, the polyethylene film 9*a* of the film layer 9 of the sheet 7 along the vent line 6 gets stretched, and the gas is led to go outside through the fine interstices formed in the boundary portions between the particles contained at random in the polyethylene film 9*a* and the polyethylene film 9*a*. Repeating this allows the packaging bag to be kept expanded to such an extent that the bag cannot burst.

According to this embodiment of the present invention, particles 9*b* contained at random in the polyethylene film 9*a* of the film layer 9 consist of non-synthetic resin such as heat resistant polyethylene and calcium carbonate which has a melting point higher than that of the polyethylene film 9*a*, as described above, so that particles 9*b* do not melt when the film layer 9 is formed. The sheet 7 is provided with a nonwoven fabric layer 10 overlapping the film layer 9 for the purpose of maintaining the strength of the sheet 7.

The present invention has been described with reference to Embodiment 1. The film layer 9 may be partially bonded to the nonwoven fabric layer 10 using an adhesive. Nonwoven fabrics other than spun-bonded nonwoven fabrics consisting of long fiber having a core-sheath structure may be used for the nonwoven fabric layer 10.

The amount of ventilation may be favorably set by varying the width of the vent line 6 depending on the contents of the body 1 of the packaging bag.

The shape of the body 1 of the packaging bag is not limited to the one illustrated in the drawings of the present invention. And the sheet 7 may be placed selectively at a suitable position according to the shape of the body of the packaging bag. Further, the sheet 7, which is used in the form of a tape in the present invention, may be cut into a circle, a triangle or a rectangle and placed on the inside of the vent line formed on the body of the packaging bag.

Figure 5:
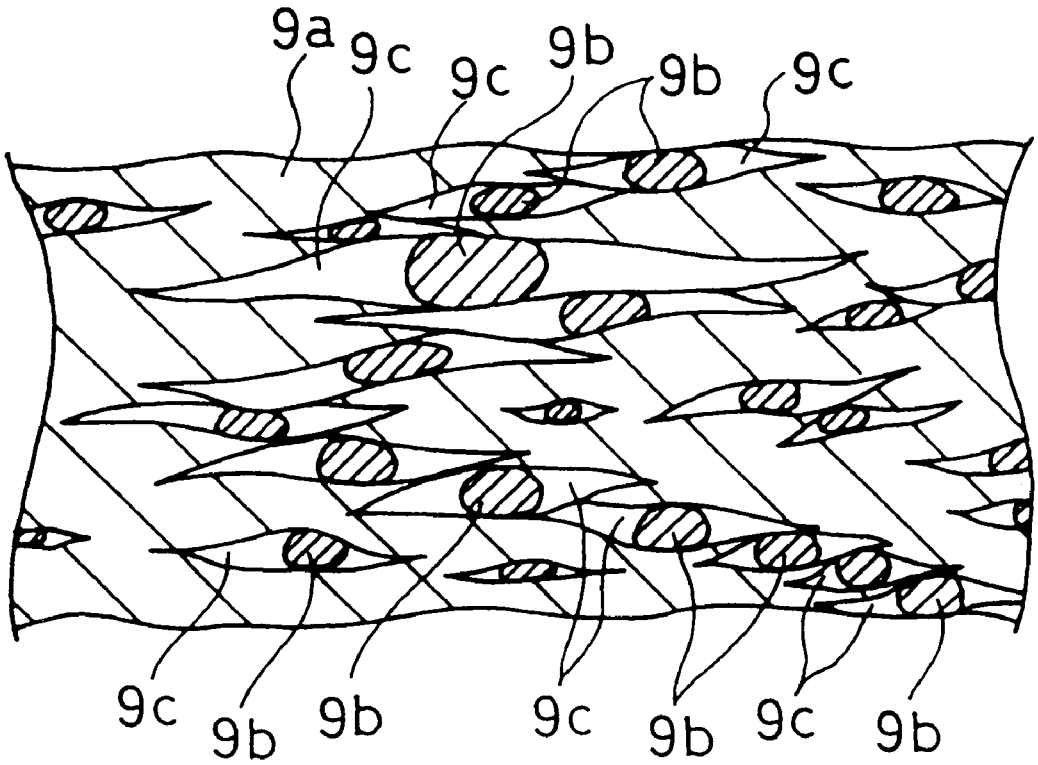
FIG. 5 is an enlarged sectional view of a film layer of a breathable sheet in a packaging bag according to the embodiment 2 of the present invention.

FIG. 5 illustrates Embodiment 2 of the present invention.

In the packaging bag according to Embodiment 1 of the present invention, the diameter of the particles 9*b* is almost the same as the thickness of the polyethylene film 9*a*. However, in the packaging bag according to Embodiment 2 of the present invention, the average diameter of the particles 9*b* is about 2 μm and is far smaller than the thickness of the polyethylene film 9*a* (about 30 μm to 50 μm). A large number of particles 9*b* are let to exist in the direction of the thickness of the polyethylene film 9*a* and the polyethylene film 9*a* is weakly stretched in the uniaxial direction. Thus, the fine interstices 9*c* oriented substantially in the same direction as the stretching direction of the polyethylene film 9*a* are formed as if to surround the particles 9*b*, as illustrated in FIG. 5, and at arbitrary spots of the polyethylene film 9*a*, there exists a portion where a number of fine interstices 9*c* are connected to each other as if to penetrate in the direction of the thickness of the polyethylene film 9*a*. In Embodiment 2, when the pressure inside the packaging bag reaches a certain level as the contained coffee beans breathe and produce gas, the gas is led to go outside through the number of fine interstices 9*c* connected to each other in the direction of the thickness of the polyethylene film 9*a*. Repeating this allows the packaging bag to be kept expanded to such an extent that the bag cannot burst, while inhibiting the air (oxygen) outside the packaging bag from flowing into the packaging bag. In FIG. 5, the fine interstices 9*c* of Embodiment 2 appear to be big since they are magnified about 1000 times bigger, but in reality, they are so small and invisible.

Figure 6:
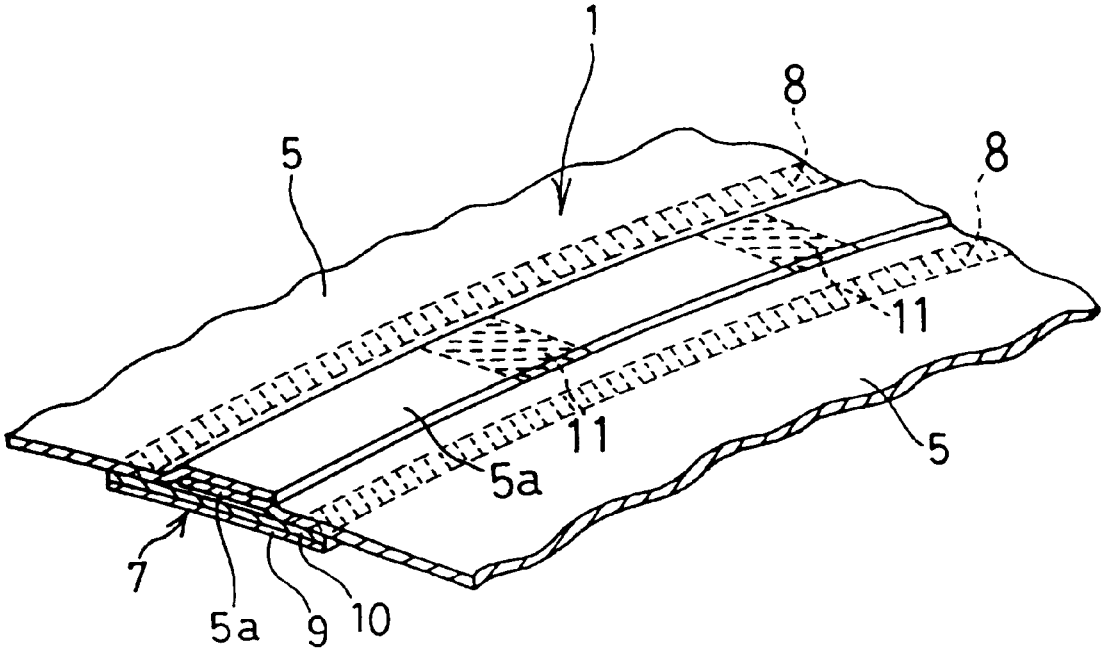
FIG. 6 is an enlarged perspective view of the main part of a packaging bag according to the embodiment 3 of the present invention.
Figure 7:
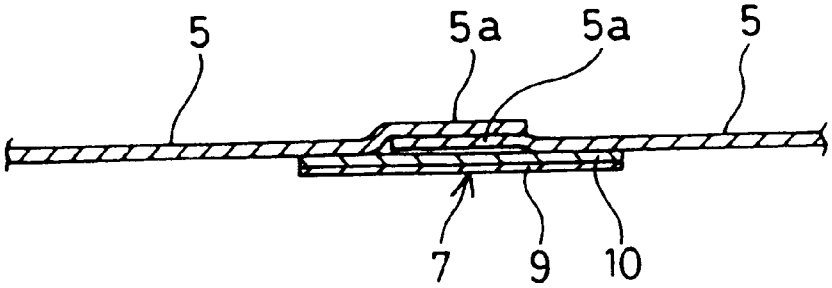
FIG. 7 is an enlarged sectional view of the main part of the packaging bag.

FIGS. 6 and 7 illustrate Embodiment 3 of the present invention.

In the packaging bag of Embodiment 1, the ends 5 and 5 of the material composing the body of the packaging bag are not perfectly butted together, but a space is left between them to form a vent line 6. In the packaging bag of Embodiment 3, a pair of cover pieces 5*a* and 5*a* are provided to be connected to each end 5 of the material composing the body of the packaging bag and to overlap with each other outside the vent line 6. One of the cover pieces 5*a* and 5*a* is overlapping the outside of the vent line 6 and the other is overlapping the former cover piece. In more particular, one cover piece 5*a* overlapping the outside of the vent line 6 is bonded by heat adhesion to the nonwoven fabric layer 10 of the sheet 7 at suitable longitudinal positions, not to the entirety of the nonwoven fabric layer 10. Reference numeral 11 indicates the heat adhesion portion. The other cover piece 5*a* is bonded by heat adhesion to the outside of the former cover piece at the positions of the heat adhesion portion 11. According as the contents of the packaging bag breathe and produce gas, the pressure inside the packaging bag gradually increases and the packaging bag expands, causing the gas to go out from the sheet 7. And the gas is further led to go outside through an interstice between the pair of cover pieces 5*a* and 5*a*.

Figure 8:
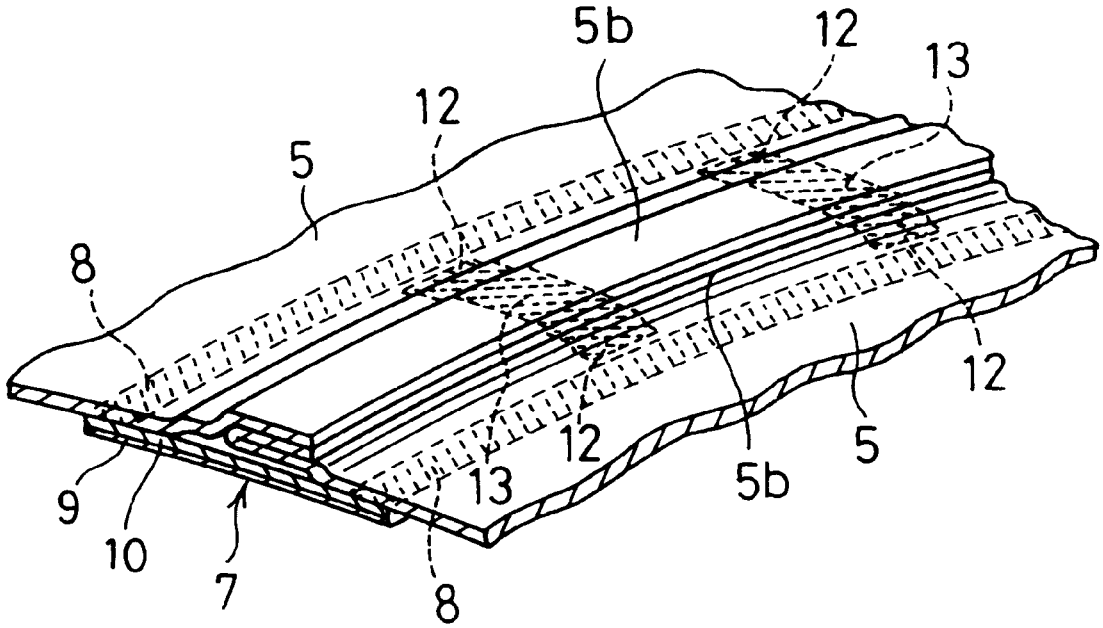
FIG. 8 is an enlarged perspective view of the main part of a packaging bag according to the embodiment 4 of the present invention.
Figure 9:
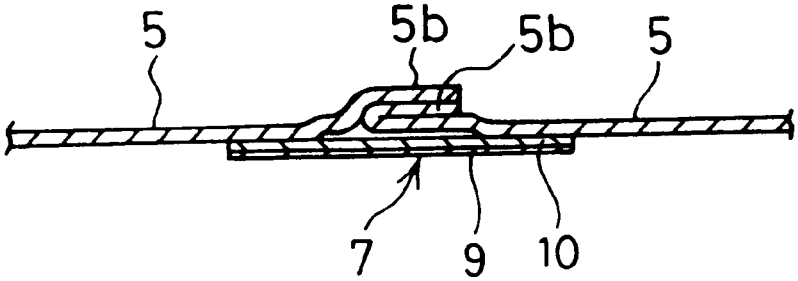
FIG. 9 is an enlarged sectional view of the main part of the packaging bag.

FIGS. 8 and 9 illustrate Embodiment 4 of the present invention.

As is shown in FIGS. 8 and 9, a pair of cover pieces 5*b* and 5*b* may be provided to be connected to each of the ends 5 and 5 of the material composing the body of the packaging bag and to overlap with each other outside the vent line 6 in the mitered manner. The pair of cover pieces 5*b* and 5*b* are bonded by heat adhesion to the nonwoven fabric layer 10 of the sheet 7 at suitable longitudinal positions, not to the entirety of the nonwoven fabric layer 10. Reference numeral 12 indicates the heat adhesion portion. The cover pieces 5*b* and 5*b* overlapping with each other in the mitered state are bonded to each other by heat adhesion at the positions of the heat adhesion portion 12. Reference numeral 13 indicates the heat adhesion portion where the cover pieces 5*b* and 5*b* are bonded to each other.

Thus, in Embodiment 4 too, according as the contents of the packaging bag breathe and produce gas, the pressure inside the packaging bag gradually increases and the packaging bag expands, causing the gas to go out from the sheet 7. And the gas is further led to go outside through an interstice between the pair of cover pieces 5*b* and 5*b*.

Figure 10:
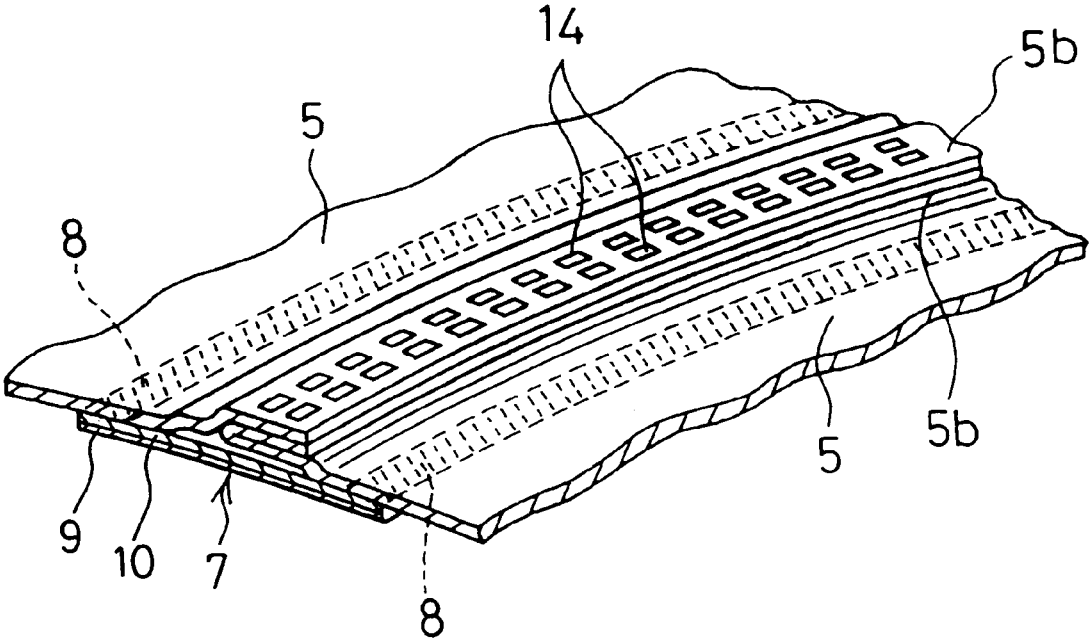
FIG. 10 is an enlarged perspective view of the main part of a packaging bag according to the embodiment 5 of the present invention.

FIG. 10 illustrates Embodiment 5 of the present invention.

In the packaging bag of Embodiment 4, the pair of cover pieces 5*b* and 5*b* overlapping with each other in the mitered state are bonded to each other by heat adhesion at the heat adhesion portion 13 at suitable intervals in the longitudinal direction of the vent line 6. In Embodiment 5, as illustrated in FIG. 10, the pair of cover pieces 5*b* and 5*b* overlapping with each other in the mitered state may be bonded to each other by heat adhesion at heat adhesion portions 14 aligned in two lines at small pitch intervals in the longitudinal direction of the vent line 6. The essential point is that the arrangement of the heat adhesion portions is not limited and that the amount of ventilation may be properly determined by adjusting the area other than the heat adhesion portions between the covers 5*b* and 5*b* overlapping with each other. In Embodiment 5, the heat adhesion portion 12 employed in Embodiment 4 is not provided.

Figure 11:
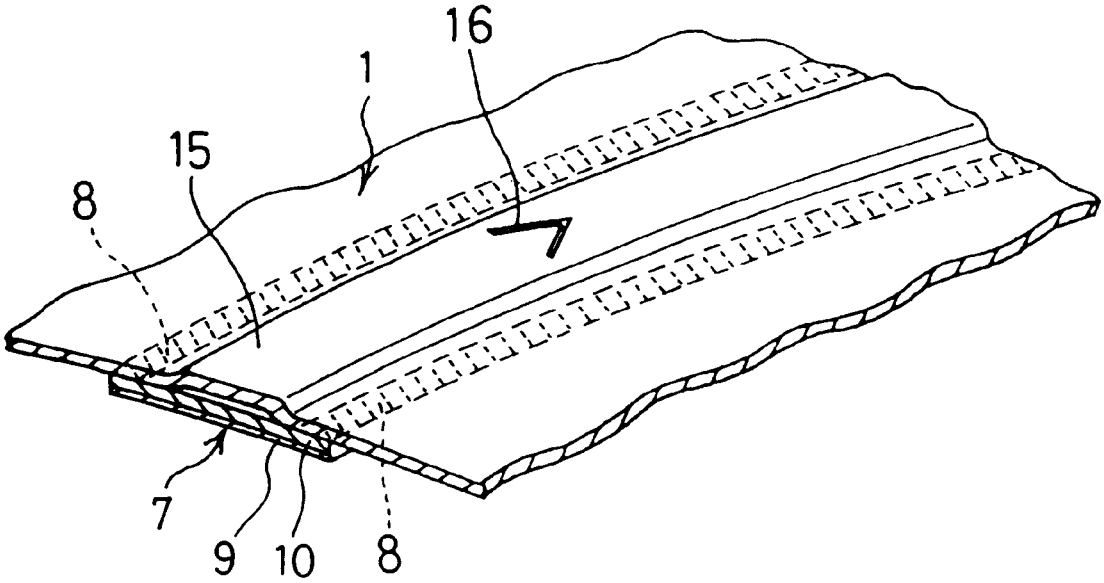
FIG. 11 is an enlarged perspective view of the main part of a packaging bag according to the embodiment 6 of the present invention.
Figure 12:
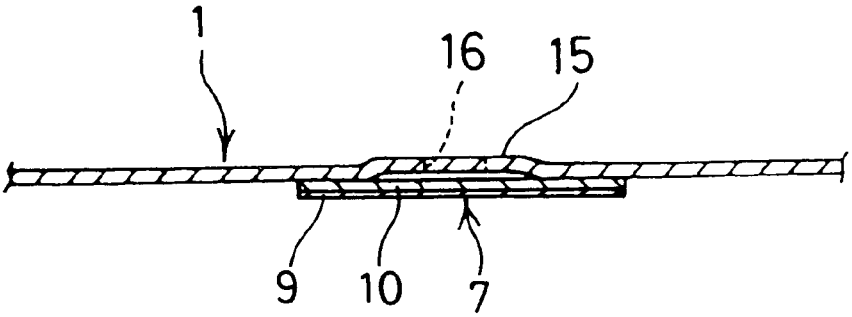
FIG. 12 is an enlarged sectional view of the main part of the packaging bag.

FIGS. 11 and 12 illustrate Embodiment 6 of the present invention.

In the packaging bag according to Embodiment 1, the ends 5 and 5 of the body 1 of the packaging bag are separated from each other, whereas in the packaging bag according to Embodiment 6, the ends 5 and 5 of the body 1 of the packaging bag are not separated from each other but connected to each other integrally. In particular, a cover portion 15 integrated with the body 1 of the packaging bag for covering the outside of the width-directional middle portion of the tape-like breathable sheet 7 is not bonded by heat adhesion to the sheet 7 except at the longitudinal ends. A V-shaped notch 16 is formed at least at one spot of the cover portion 15. The gas produced by the contents and passed through the sheet 7 is led through the space between the sheet 7 and the cover portion 15 to go outside of the body 1 of the packaging bag through the notched portion 16. The notched portion may be of other shapes than the V shape.

In each of the embodiments described above, the body of the packaging bag previously bent into a cylindrical shape is filled with contents such as coffee beans which breathe and produce gas, and is subsequently closed at the ends by heat adhesion. However, the body of the packaging bag may be bent into a cylindrical shape while it is being filled with such contents.

I claim:

1. A packaging bag for storing contents that produce gas, said bag comprising:

a body having first and second ends and a vent slit between said first and second ends;

a nonwoven fabric layer disposed on an inner surface of the body and extending between the first and second ends of the body;

a synthetic resin layer disposed on an inner surface of said nonwoven fabric layer, said synthetic resin layer having particles and being breathable and stretchable in an uniaxial direction;

said body, nonwoven fabric layer and synthetic resin film layer being bonded together so as to prevent the contents of said bag from escaping through said vent slit; and a pair of cover pieces disposed on said first and second ends of the body wherein one of said cover pieces overlaps the outside of the vent slit and the other cover piece overlaps the outside of the former cover piece and said pair of cover pieces are partially bonded together by a heat adhesion connection at heat adhesion portions.

2. A packaging bag for storing contents that produce gas, said bag comprising:

a body having first and second ends and a vent slit between said first and second ends;

a nonwoven fabric layer disposed on an inner surface of the body and extending between the first and second ends of the body;

a synthetic resin layer disposed on an inner surface of said nonwoven fabric layer, said synthetic resin layer having particles and being breathable and stretchable in an uniaxial direction;

said body, nonwoven fabric layer and synthetic resin film layer being bonded together so as to prevent the contents of said bag from escaping through said vent slit; and a pair of cover pieces disposed on said first and second ends of the body wherein said cover pieces overlap each other in a mitered connection outside the vent slit and along a vertical axis of the vent slit and said pair of cover pieces are partially bonded together by a heat adhesion connection at heat adhesion portions.

3. A packaging bag for storing contents that produce gas, said bag comprising:

a body having first and second ends and a vent slit between said first and second ends;

a nonwoven fabric layer disposed on an inner surface of the body and extending between the first and second ends of the body;

a synthetic resin layer disposed on an inner surface of said nonwoven fabric layer, said synthetic resin layer having particles and being breathable and stretchable in an uniaxial direction;

said body, nonwoven fabric layer and synthetic resin film layer being bonded together so as to prevent the contents of said bag from escaping through said vent slit; and a pair of cover pieces disposed on said first and second ends of the body wherein said cover pieces overlap with each other in a mitered connection outside the vent slit and along a vertical axis of the vent slit, and these cover pieces are at least partially bonded together by a heat adhesion connection at heat adhesion portions aligned in small intervals.

4. A packaging bag according to claim 3, wherein the heat adhesion portions are aligned in small pitch intervals.

* * * * *